US006974340B2

(12) United States Patent
Zech et al.

(10) Patent No.: US 6,974,340 B2
(45) Date of Patent: Dec. 13, 2005

(54) ELECTRICAL CONNECTOR

(75) Inventors: Thomas Zech, Voehrenbach (DE); Frank Roese, Donaueschingen (DE)

(73) Assignee: IMS Connector Systems GmbH, Loeffingen (DE)

( * ) Notice: Subject to any disclaimer, the term of this patent is extended or adjusted under 35 U.S.C. 154(b) by 0 days.

(21) Appl. No.: 09/748,066

(22) Filed: Dec. 22, 2000

(65) Prior Publication Data

US 2001/0005645 A1 Jun. 28, 2001

(30) Foreign Application Priority Data

Dec. 22, 1999 (DE) ..... 199 62 437

(51) Int. Cl.[7] ..... H01R 29/00
(52) U.S. Cl. ..... 439/188; 439/581; 439/141
(58) Field of Search ..... 439/188, 510, 439/620, 63, 944, 581, 140, 141

(56) References Cited

U.S. PATENT DOCUMENTS

| | | | | |
|---|---|---|---|---|
| 4,575,694 A | | 3/1986 | Lapke et al. | 333/22 |
| 4,591,732 A | * | 5/1986 | Neuenschwander | 307/140 |
| 4,633,048 A | | 12/1986 | Komatsu | 200/51.1 |
| 5,167,520 A | | 12/1992 | Henry et al. | 439/266 |
| 5,226,827 A | * | 7/1993 | Corcoles et al. | 439/140 |
| 5,275,575 A | | 1/1994 | Cahaly et al. | 439/188 |
| 5,322,453 A | * | 6/1994 | Resnick et al. | 439/581 |
| 5,338,215 A | * | 8/1994 | Lee et al. | 439/188 |
| 5,466,160 A | * | 11/1995 | Ogura | 333/260 |
| 5,470,243 A | * | 11/1995 | Bendorf | 439/188 |
| 5,882,224 A | * | 3/1999 | Gauker | 439/510 |
| 5,890,913 A | * | 4/1999 | Kyllonen | 439/63 |
| 5,893,767 A | * | 4/1999 | Broschard, III | 439/188 |
| 5,944,547 A | * | 8/1999 | Golab et al. | 439/188 |
| 5,989,046 A | * | 11/1999 | Togashi | 439/188 |
| 6,068,499 A | * | 5/2000 | Kuriyama et al. | 439/188 |
| 6,074,217 A | * | 6/2000 | Maruyama et al. | 439/63 |
| 6,099,334 A | * | 8/2000 | Togashi | 439/188 |
| 6,106,314 A | * | 8/2000 | McLean et al. | 439/188 |
| 6,146,168 A | * | 11/2000 | Ishii | 439/168 |
| 6,162,078 A | * | 12/2000 | Chung | 439/188 |
| 6,231,362 B1 | * | 5/2001 | Wu | 439/188 |
| 6,241,541 B1 | * | 6/2001 | Hida | 439/188 |
| 6,280,214 B1 | * | 8/2001 | Chang | 439/188 |
| 6,296,492 B1 | * | 10/2001 | Fujimoto et al. | 439/188 |
| 6,322,397 B1 | * | 11/2001 | Zhang | 439/188 |

FOREIGN PATENT DOCUMENTS

| | | |
|---|---|---|
| DE | 40 10 121 A1 | 10/1990 |
| DE | 38 34 171 | 12/1990 |

(Continued)

*Primary Examiner*—Gary Paumen
*Assistant Examiner*—Ewin A. Leon
(74) *Attorney, Agent, or Firm*—O'Shea, Getz & Kosakowski, P.C.

(57) ABSTRACT

An electrical plug connector assembly includes a socket connector and a plug connector. The socket connector includes a housing within which a U-shaped contact spring physically contacts a fixed contact part to establish an electrical connection. The U-shaped contact spring is disposed horizontally within the housing, in such a way that an imagined bending axis of the U-shaped contact spring lies parallel to the plug direction. The horizontal arrangement of the U-shaped contact spring within the housing makes it possible for the socket connector to have a relatively flat structure. A preferred application of such a plug connector unit is within a mobile telephone.

18 Claims, 4 Drawing Sheets

FOREIGN PATENT DOCUMENTS

| | | | |
|---|---|---|---|
| DE | 38 34 171 | C2 | 5/1994 |
| DE | 299 13 911 | | 10/1999 |
| EP | 0 005 861 | B1 | 12/1981 |
| EP | 0 739 059 | A2 | 10/1996 |
| EP | 0 782 219 | A1 | 7/1997 |
| EP | 0 945 931 | A2 | 9/1999 |
| GB | 2 238 672 | | 1/1990 |
| JP | 07 28 81 59 | A | 10/1995 |
| WO | WO 98/31078 | | 7/1998 |
| WO | WO 99/62140 | | 12/1999 |

* cited by examiner

ELECTRICAL CONNECTOR

BACKGROUND OF THE INVENTION

The present invention relates to electrical connectors, and in particular to electrical connector assemblies that include a plug connector and a socket connector.

A plug connector unit with a socket connector which has a switching function is described in the published patent application designated WO 98/31078. The socket connector described therein has a contact pin centered in the socket connector. When a plug connector is inserted, this pin is moved away axially from the plug opening. That end of the contact pin facing away from the plug side contacts one leg of a contact spring. The contact leg of this contact spring touches a reciprocal contact when it is in its idle state (i.e., when no plug connector is plugged into the socket connector). If a plug connector is plugged into the socket connector, the contact pin of the socket connector presses the leg of the contact spring away from the reciprocal contact, so the electrical connection between the contact spring and the reciprocal contact is broken. The virtual bending axis of the contact spring is perpendicular to the plug direction.

A problem with this plug connector unit is that it has a relatively complicated structure. Furthermore, the socket connector requires a centered contact pin, over which the contact spring is moved. The socket connector altogether is a relatively long axial structure.

Therefore, there is a need for an improved electrical plug connector assembly, and its constituent plug and socket connector components.

SUMMARY OF THE INVENTION

Briefly, according to one aspect of the invention, a socket connector includes a socket housing having a socket receiving aperture formed by a socket housing wall. A U-shaped first contact part is mounted within the socket housing and includes first and second walls that are nominally parallel. A second contact part is also mounted within the socket housing and nominally contacts the first movable contact part to provide an electrical connection between the first and second contact parts. When a plug connector is inserted into the socket receiving aperture the first wall flexes radially with respect to the second wall breaking the electrical connection between the U-shaped contact part and the second second contact part.

According to another aspect of the invention, a plug connector includes a plug housing and a contact pin that runs axially through at least a portion of the length of the plug housing. The contact pin includes a pin base portion and a pin projecting portion. An insulating shell that coaxially surrounds the pin base portion, and a metallic shell that coaxially surrounds the insulating shell. A spring loaded slider shell is in spaced relationship coaxially surrounds the pin projecting portion, wherein the slider shell axially slides upward when the plug connector is inserted into a socket connector to expose the pin projecting portion axially beyond the upwardly slid spring loaded slider shell.

According to yet another aspect of the invention, an electrical plug connector assembly includes a socket connector and a plug connector. The socket connector includes a socket housing having a socket receiving aperture formed by a housing wall. A U-shaped first contact part is mounted within the socket housing and includes first and second walls that are nominally parallel. A second contact part is also mounted within the socket housing and nominally contacts the first movable contact part to provide an electrical connection between the first and second contact parts. When a plug connector is inserted into the socket receiving aperture, the first wall flexes relative to the second wall breaking the electrical connection between the U-shaped contact part and the second contact part. The plug connector includes a plug housing and a contact pin that runs axially through at least a portion of the length of the plug housing. The contact pin includes a pin base portion and a pin projecting portion. An insulating shell coaxially surrounds the pin base portion, and a metallic shell coaxially surrounds the insulating shell. A spring loaded slider shell is mounted in spaced relationship with and coaxially surrounds the pin projecting portion. The slider shell axially slides upward when the plug connector is inserted into the socket connector to expose the pin projecting portion that axially projects beyond the upwardly slid spring loaded slider shell, and the pin projecting portion engages the first wall causing the first wall to radially flex relative to the second wall breaking the electrical connection between the walls.

These and other objects, features and advantages of the present invention will become more apparent in light of the following detailed description of preferred embodiments thereof, as illustrated in the accompanying drawings.

DETAILED DESCRIPTION OF THE INVENTION

Figure 2:
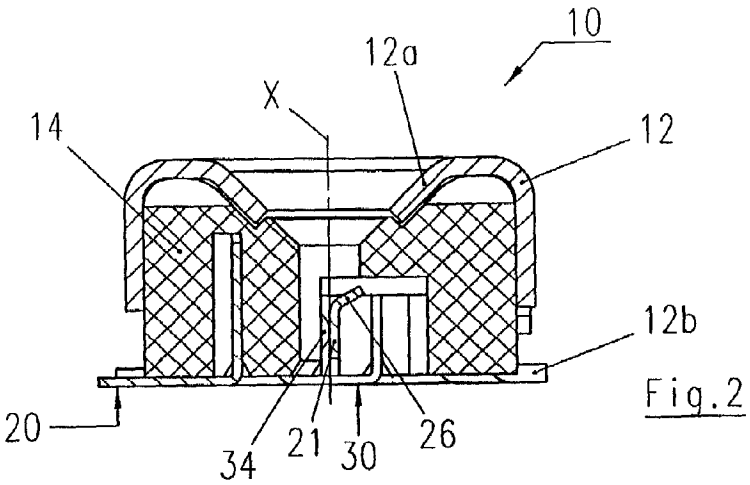
FIG. 2 illustrates a sectional view of the socket connector of FIG. 1 taken along line A.
Figure 1:
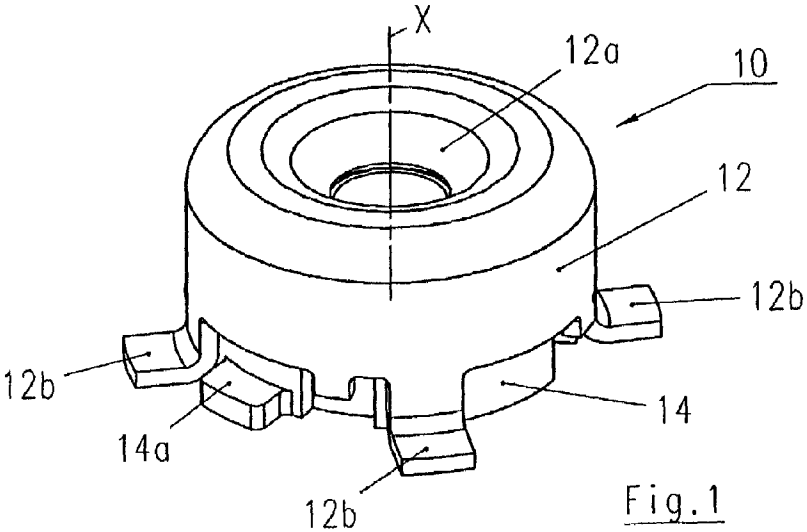
FIG. 1 illustrates a perspective view of a socket connector.
Figure 3:
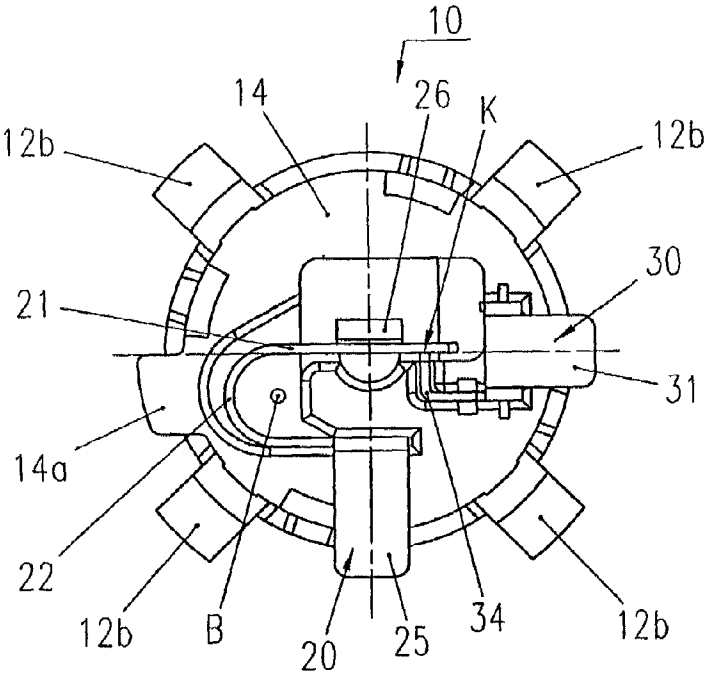
FIG. 3 illustrates a bottom view of the socket connector of FIG. 1.

Referring to FIGS. 1–3, a socket connector 10 is constructed about a central axis X. The socket connector 10 includes a pot-shaped housing 12, whose floor has four housing feet 12*b*, set outward at a right angle. The side of the housing 12 facing away from the housing floor (i.e., the plug side) has a housing wall 12*a* angled inward at a slant. The housing wall 12*a* slopes inward similar to a funnel (i.e., tapered) to facilitate insertion of the plug connector, which will be explained below in connection with FIGS. 6–8. The housing 12 includes metal and is preferably produced as a deep-drawn part.

An insulation part 14 is seated and preferably retained/clamped in the housing 12. This clamping mount may be achieved, for example, by caulking the lower housing edge after the insulating part 14 has been pushed into the housing 12. In addition, the insulating part 14 has one or more identification protrusions 14*a*, so the position of the socket connector 10 can be uniquely identified. Such an identification is necessary if the socket connector 10, as an SMD structural element, is mounted and soldered automatically on a circuit board in a production line.

Figure 4:
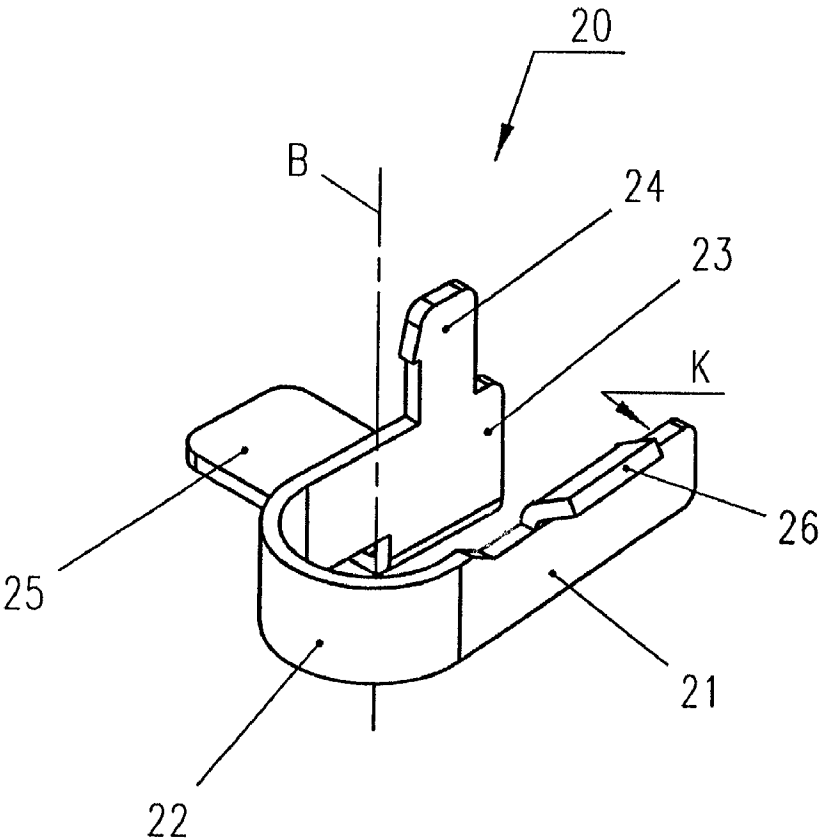
FIG. 4 illustrates a perspective view of a U-shaped contact spring inserted into the socket pocket of FIGS. 1–3.

The socket connector also includes contact parts 20, 30 that are seated in the insulating part 14. FIG. 4 illustrates a perspective view of the first contact part 20. The contact part 20 includes a U-shaped contact spring with two walls 21, 23, which are integrally connected by a U-shaped wall 22. The walls 21, 23 are spaced apart and mutually parallel. At the lower edge of the wall 23 (in FIG. 4), a connection plate 25 extends outward at a right angle opposite to the wall 21. For example, the antenna output of the electronics of a mobile telephone is connected to this connection plate 25. For this purpose, the socket connector 10 is situated on a circuit board housed in the mobile telephone. A holding protrusion 24 extends from the upper edge of the wall 23 of the U-shaped contact spring 20. The upper edge of the other wall 21 of the U-shaped contact spring 20 is integrally connected to a wall 26, which protrudes outward at a slant (i.e., slopes outward). The wall 26 facilitates insertion of a contact pin 55 (FIG. 6) into the socket connector 10 and serves as a stop for this pin. Altogether, the wall section 21 can be sprung back and forth through the U-shaped wall section 22.

Figure 5:
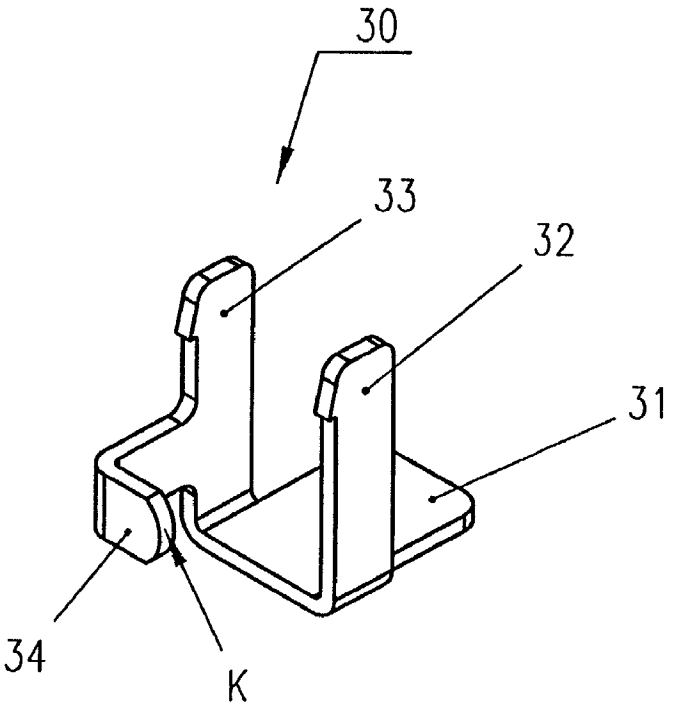
FIG. 5 illustrates a perspective view of a second contact part inserted into the socket connector of FIGS. 1–3.

FIG. 5 illustrates a perspective view of the second contact part 30. The second contact part 30 includes a connection plate 31, from whose left and right outer edges two holding protrusions 32, 33 extend upward at a distance from one another. An L-shaped wall section 34 is integrally attached to the left holding protrusion 33.

The U-shaped contact spring 20 and the second contact part 30 are inserted into the insulating part 14 as shown in FIGS. 2 and 3. The holding protrusions 24, 32, and 33 (FIGS. 4–5), each of which has a barb, hold the contact spring 20 and the contact part 30 fast in the insulating part 14. In the non-loaded state (i.e., when a plug connector is not inserted into the socket connector 10) an electrical connection exists between the U-shaped contact spring 20 and the second contact part 30. This electrical connection is established by contact between the U-shaped contact spring 20 and the contact part 30 when they touch at the contact points in the area designated K in FIGS. 4 and 5.

As set forth above, when the circuit part 10 is in its mounted state the connection plate 25 is connected, for example, to the electronics of a mobile telephone. The electrical connection between the connection plate 25 of the U-shaped contact spring 20 and the connection plate 31 of the second contact part 30 is established by the wall 21 contacting the wall 34 of the second contact part 30. For this purpose, the wall 21 of the U-shaped contact spring 20 contacts the wall 34 of the second contact part 30 with a spring pre-tension. Significantly, the U-shaped contact spring 20 is built into the insulation part 14 of the socket connector 10.

Referring to FIGS. 1–5, the U-shaped contact spring 20 is built horizontally into the insulation part 14 or into the housing 12 of the socket connector 10. Horizontal means that an imagined bending axis, designated by B in FIGS. 3 and 4, extends parallel to the plug direction. If the contact pin is inserted into the pass-through opening along the axis X of the socket connector 10, the freely mobile leg of the U-shaped contact spring 20 (i.e., the wall 21 with the insertion aid 26) is pressed away from the opposite wall 23, and as a result the contact with the wall 34 of the second contact part 30 is broken. Consequently, when the contact pin is inserted into the pass-through opening of the socket connector 10, there is no longer an electrical connection between the connection plate 25 and the connection plate 31. Rather, there is an electrical connection between the U-shaped contact spring 20 and the contact pin itself. If the contact pin is connected to an external antenna, the connection plate 25 and thus the electronics of a mobile telephone are connected to an external antenna that is connected to the contact pin.

Figure 7:
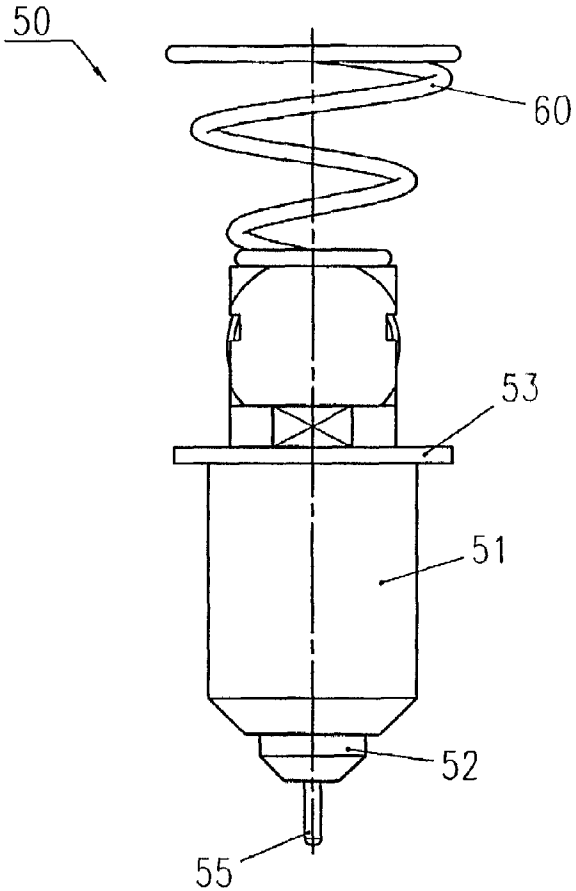
FIG. 7 illustrates a side view of the plug connector illustrated in FIG. 6.
Figure 8:
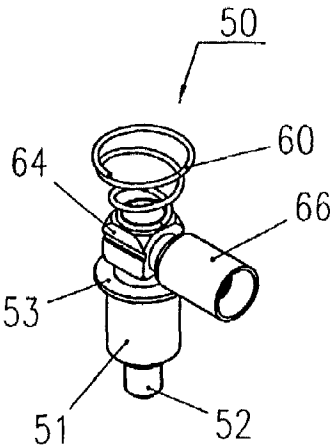
FIG. 8 illustrates a perspective view of the plug connector of FIGS. 6–7.
Figure 6:
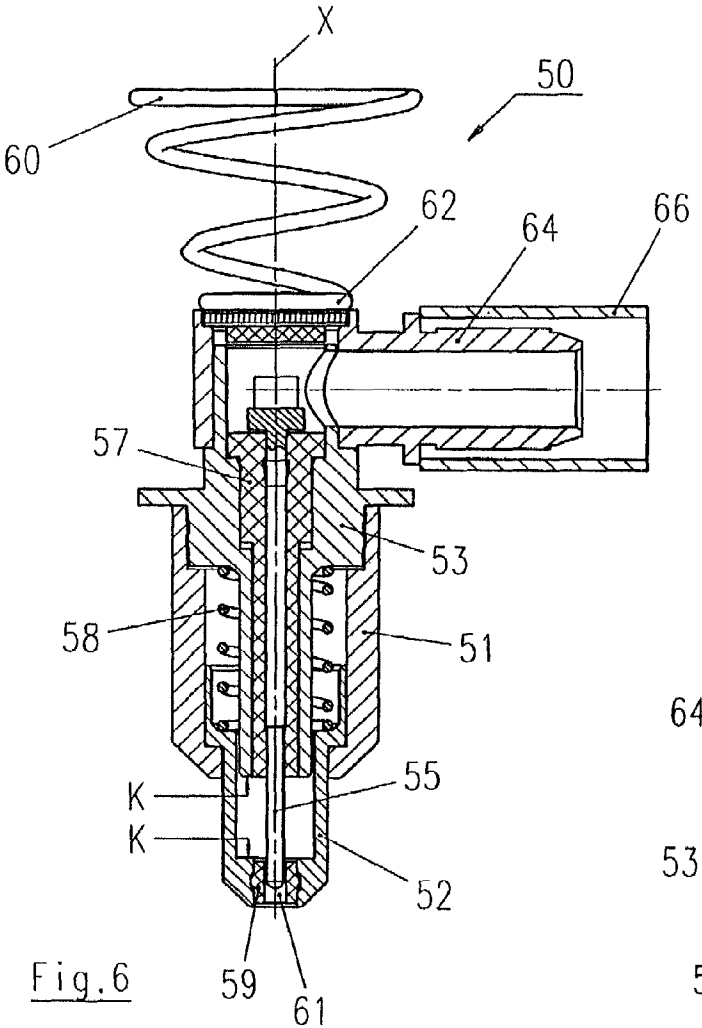
FIG. 6 illustrates a sectional view of a plug connector for a socket connector in accordance with FIGS. 1–3.

FIGS. 6–8 illustrate various views of a plug connector 50 that cooperates with the socket connector 10 (FIGS. 1–5) to provide the plug connecter. FIG. 6 illustrates a sectional view of the plug connector. FIG. 7 illustrates a side view of the plug connector illustrated in FIG. 6. FIG. 8 illustrates a perspective view of the plug connector of FIGS. 6–7. Referring to FIGS. 6–8, the plug connector 50 includes a T-shaped housing and a centered contact pin that is fixed within the housing of the contact part 50. The contact pin 55 is seated in an insulating shell 57, which is surrounded by a metallic shell 53. The front end of the contact pin 55 extends beyond the insulating shell 57 and the metallic shell 53. The front end of the contact pin 5 is surrounded by a slider shell 52, which is disposed movably and axially along the axis X. The slider shell 52 can move against the force of the helical spring 58. The helical spring 58 and the upper end of the slider shell 52 are surrounded by a housing shell 51. The slider shell 52 has a central pass-through opening 61, within which is seated an electrically non-conducting guide shell 59.

The connection part of the plug connector 50 protrudes at a right angle, and includes a crimp connection 64 surrounded by a shell 66. The end of the plug connector 50 that faces away from the plug side is covered by a cover plate 62 coupled to a spring device 60.

As shown in FIG. 6, the plug connector part 50 is in its idling state. In this state the pressure spring 58, whose upper end is supported against the shell 53 and whose lower end is supported against the slider shell 52, presses the slider shell 52 over the front end of the contact pin 55. The tip of the contact pin 55 is seated between the guide shell 59 and does not extend beyond the front end of the slider shell 52. If the plug connector part 50 is inserted into a fitting socket connector 10, the slider shell 52 slides back against the force of the pressure spring 58 so the front end of the contact pin 55 extends out of the slider shell 52. This position is illustrated in FIG. 7.

As illustrated in FIG. 7, the slider shell 52 is in its retracted position, and the front annular end of the metallic shell 53 touches the inner wall of the metallic slider shell 52, which is seated on the housing of the socket connector 10. This ensures good ground contact from the housing of the socket connector 10 to the ground connection of the coaxial cable connected to the plug connector 50. In FIG. 6, the contact points at the shell 53 and at the slider shell 52 are again marked by the reference symbol K. In a preferred embodiment, the front end of the metallic shell 53 protrudes at least minimally beyond the front end of the insulating shell 57 to provide good ground contact.

Figure 9:
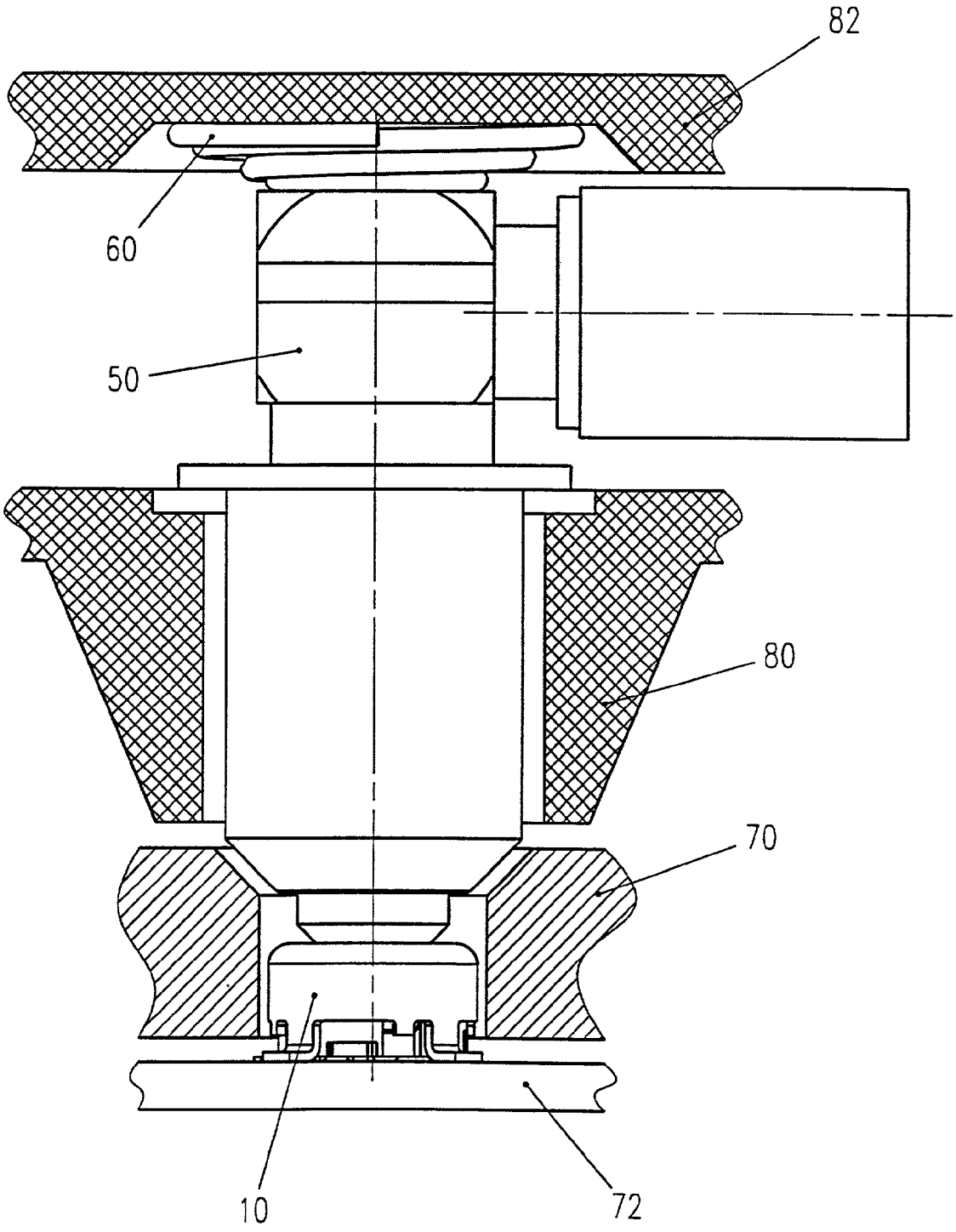
FIG. 9 illustrates a side view of a plug connector assembly that includes the socket connector and the plug connector, in its assembled state.

FIG. 9 illustrates a plug connector assembly that includes the socket connector 10 (FIGS. 1–5) and the plug connector 50 (FIGS. 6–8) plugged together in the mounted state. For example, the plug connector 10 is situated on a circuit board 72 of a mobile telephone, soldered in SMD technology. The socket connector 10 is situated in an opening of a housing wall 70 of the mobile telephone. For example, the external mobile radio antenna of a motor vehicle is connected to the plug connector 50, which is built into the mobile telephone mount of the motor vehicle. This mount has two walls 80, 82 situated one behind the other. The wall 82 is fixed, while the wall 80 may move somewhat axially. If an operator places the mobile telephone into the mobile telephone mount of the vehicle, the spring device 60 is pressed together in the manner shown in FIG. 9, and an electrical connection is established between the external antenna and the electronics of the mobile telephone. The electrical contact with the mobile telephone antenna, that is the antenna built into the mobile telephone itself, is then broken.

Although the present invention has been shown and described with respect to several preferred embodiments thereof, various changes, omissions and additions to the form and detail thereof, may be made therein, without departing from the spirit and scope of the invention.

What is claimed is:

1. A socket connector that mates with a plug connector to establish an electrical plug connector assembly, said socket connector comprising:

a housing that includes a socket receiving aperture having a center axis and formed by a housing wall;

a U-shaped first contact part mounted within said housing and including first and second walls that are nominally parallel and separated by the center axis; and a second contact part mounted within said housing to nominally contact said U-shaped first contact part in order provide an electrical connection between said first and second contact parts, wherein when the plug connector is inserted along the center axis into said socket receiving aperture said first wall flexes radially with respect to the center axis breaking the electrical connection between said U-shaped first contact part and said second contact part.

2. The socket connector of claim 1, wherein said first wall flexes radially away from said second wall when the plug connector is inserted into said socket receiving aperture.

3. The socket connector of claim 2, wherein said first and second walls are integrally connected by a semicircular wall of said U-shaped first contact part, and said socket connector comprises a radially outward sloped guide wall mounted to said first wall, wherein said sloped guide wall facilitates moving said first wall radially away from said second wall as the plug connector is inserted into said socket receiving aperture.

4. The socket connector of claim 3, comprising a connection plate integrally attached to said U-shaped first contact part.

5. The socket connector of claim 3, comprising a least one holding protrusion integrally attached to said U-shaped first contact part.

6. The socket connector of claim 2, wherein said housing is pot-shaped and includes a central pass-through opening for inserting a contact pin of the plug connector, said U-shaped first contact part extending at least partially into said pass-through opening.

7. The socket connector of claim 2, wherein said housing includes an insulating part into which said second contact part and said U-shaped first contact part are inserted and operably positioned.

8. The socket connector of claim 7, wherein said second contact part and said U-shaped first contact part each comprise at least one holding protrusion that engages said insulating part to hold said second contact part and said U-shaped first contact part axially in place.

9. The socket connector of claim 8, wherein said insulating part includes at least one identification protrusion that extends from a main body of said insulating part, wherein said identification protrusion identifies the position of said socket connector.

10. A plug connector that mates with a socket connector to establish an electrical plug connector assembly, said plug connector comprising:

a housing;

a contact pin that runs axially through at least a portion of the length of said housing, and includes a pin base portion and a pin projecting portion;

an insulating shell that coaxially surrounds said pin base portion;

a metallic shell that coaxially surrounds said insulating shell; and a spring loaded slider shell that in spaced relationship coaxially surrounds said pin projecting portion, wherein said spring loaded slider shell axially slides upward when said plug connector is inserted into the socket connector to expose said pin projecting portion, wherein said spring loaded slider shell comprises an axial exterior section that includes an outlet coaxial with said pin projecting portion, wherein said pin projecting portion axially passes through said outlet, and said outlet is formed by an electically non-conducting guide shell positioned between said pin projecting portion and said spring loaded slider shell.

11. The plug connector of claim 10, comprising a spring that is mounted to a first axial end of said housing axially opposite to said spring loaded slider shell to support said plug connector against a mounting wall.

12. The plug connector of claim 10, wherein said spring loaded slider shell comprises a coiled spring.

13. The plug connector of claim 10, wherein said housing comprises a crimp connection for connecting a coaxial line.

14. An electrical plug connector assembly, comprising:

A. a socket connector, that includes a socket housing having a socket receiving aperture formed by a housing wall;

a U-shaped first contact part mounted within said socket housing and including first and second walls that are nominally parallel;

a second contact part mounted within said socket housing to nominally contact said first movable contact part in order provide an electrical connection between said first and second contact parts, wherein when a plug connector is inserted into said socket receiving aperture said first wall flexes relative to said second wall breaking the electrical connection between said U-shaped contact part and said second contact part;

B. said plug connector comprising a plug housing;

a contact pin that runs axially through at least a portion of the length of said plug housing, and includes a pin base portion and a pin projecting portion;

an insulating shell that coaxially surrounds said pin base portion;

a metallic shell that coaxially surrounds said insulating shell; and a spring loaded slider shell that in spaced relationship coaxially surrounds said pin projecting portion, wherein said slider shell axially slides upward when said plug connector is inserted into said socket connector to expose said pin projecting portion that axially projects beyond said spring loaded slider shell and engages said first wall causing said first wall to radially flex relative to said second wall.

15. A socket connector that mates with a plug connector to establish an electrical plug connector assembly, said socket connector comprising:

a housing that includes a socket receiving aperture having a receiving aperture axis and formed by a housing wall;

a U-shaped first contact part mounted within said housing and including first and second walls that are nominally parallel and separated by the receiving aperture axis; and a second contact part mounted within said housing to nominally contact said U-shaped first contact part to provide an electrical connection between said first and second contact parts, wherein when the plug connector is inserted along the receiving aperture axis into said socket receiving aperture said first wall flexes radially with respect to the receiving aperture axis breaking the electrical connection between said U-shaped first contact part and said second contact part.

16. The socket connector of claim 15, wherein said first wall flexes radially away from said second wall when the plug connector is inserted into said socket receiving aperture.

17. The socket connector of claim 16, wherein said first and second walls are integrally connected by a semicircular wall of said U-shaped first contact part, and said socket connector comprises a radially outward sloped guide wall mounted to said first wall, wherein said sloped guide wall facilitates moving said first wall radially away from said second wall as the plug connector is inserted into said socket receiving aperture.

18. A plug connector that mates with a socket connector to establish an electrical plug connector assembly, said plug connector comprising:

a housing;

a contact pin that runs axially through at least a portion of the length of said housing, and includes a pin base portion and a pin projecting portion;

an insulating shell that axially surrounds said pin base portion;

a metallic shell that axially surrounds said insulating shell; and a spring loaded slider shell that in spaced relationship axially surrounds said pin projecting portion, wherein said spring loaded slider shell axially slides upward when said plug connector is inserted into the socket connector to expose said pin projecting portion, wherein said spring loaded slider shell comprises an axial exterior section that includes an outlet coaxial with said pin projecting portion, wherein said pin projecting portion axially passes through said outlet, and said outlet is formed by an electically non-conducting guide shell positioned between said pin projecting portion and said spring loaded slider shell.

* * * * *

UNITED STATES PATENT AND TRADEMARK OFFICE

CERTIFICATE OF CORRECTION

PATENT NO. : 6,974,340 B2
APPLICATION NO. : 09/748066
DATED : December 13, 2005
INVENTOR(S) : Zech et al.

It is certified that error appears in the above-identified patent and that said Letters Patent is hereby corrected as shown below:

Column 1 line 57, before "socket" delete "a" and insert --the--
line 58, before "axially" insert --to--

Column 6

In the claims, claim 10, line 21, delete "electically" and insert --electrically--

Signed and Sealed this

Twenty-seventh Day of March, 2007

JON W. DUDAS
*Director of the United States Patent and Trademark Office*